US006695506B2

(12) United States Patent
Yamamoto

(10) Patent No.: US 6,695,506 B2
(45) Date of Patent: Feb. 24, 2004

(54) PLATEN SUPPORTING DEVICE

(75) Inventor: Hajime Yamamoto, Mishima (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 45 days.

(21) Appl. No.: 09/946,670

(22) Filed: Sep. 6, 2001

(65) Prior Publication Data

US 2002/0044812 A1 Apr. 18, 2002

(30) Foreign Application Priority Data

Sep. 7, 2000 (JP) ..... 2000-270927

(51) Int. Cl.[7] ..... B41J 29/10
(52) U.S. Cl. ..... 400/689; 400/690
(58) Field of Search ..... 400/689, 690, 400/661, 656, 648

(56) References Cited

U.S. PATENT DOCUMENTS 4,215,946 A * 8/1980 Nakabo et al. ..... 400/689
4,278,018 A * 7/1981 Johannesson ..... 101/93
4,318,452 A * 3/1982 Reitner ..... 181/207
4,573,816 A * 3/1986 Pamler ..... 400/661
2001/0010775 A1 * 8/2001 Togashi et al. ..... 400/649

* cited by examiner

*Primary Examiner*—Anthony H. Nguyen
(74) *Attorney, Agent, or Firm*—Oblon, Spivak, McClelland, Maier & Neustadt, P.C.

(57) ABSTRACT

In the present invention, a flat platen having a flat surface opposed to a print head is fixed to a platen supporting member by a fixing member, and a first impact absorbing member is disposed elastically between the platen and the platen supporting member. Accordingly, the propagation of vibration between the platen and the platen supporting member is prevented by a vibration absorbing action of the first impact absorbing member and vibrations in a vibration generation source are absorbed quickly. Thus, according to the present invention, a printing noise can be damped effectively.

17 Claims, 6 Drawing Sheets

PLATEN SUPPORTING DEVICE

CROSS REFERENCE TO RELATED APPLICATION

The present application is based on Japanese Priority Document 2000-270927 filed on Sep. 7, 2000, the content of which is incorporated herein by reference.

BACKGROUND OF THE INVENTION

1. Field of the Invention

The present invention relates to a platen supporting device for supporting a platen of a printer.

2. Discussion of the Background

As a platen of a printer, not only a platen called platen roller having a paper feed function, but also a flat platen not having a paper feed function is known. In such a platen, both ends thereof are fixed to platen supporting members such as frames opposed to each other. A more concrete description will be given below with reference to FIGS. 7 and 8, of which FIG. 7 is an exploded perspective view showing a part of a platen supporting structure and FIG. 8 is a side view thereof.

A platen 15 is a flat type and is disposed in opposition to a wire dot head 20. Mounting holes 15*a* are formed in both longitudinal ends of the platen 15. Mounting screws 26 are inserted respectively through the mounting holes 15*a* and are threadedly engaged with platen supporting members 25 formed in frames 24 for example, whereby the platen 15 is fixed.

In the printer, however, there occurs noise during conveyance of paper, during movement of a carriage with the wire dot head 20 mounted thereon, or when the wire dot head 20 is driven during movement of the carriage. Particularly, in case of using an impact type wire dot head 20, the platen 15 is a loudest noise generation source because it is struck by the wire dot head 20.

As shown in FIGS. 7 and 8, in the case where the platen 15 is mounted directly to the platen supporting members 25, vibrations of the platen 15 are transmitted to the platen supporting members 25. The vibrations are propagated to the frames 24 and are amplified thereby, thus generating a loud printing noise. For damping this noise there has been adopted, for example, a measure of affixing a sound absorbing material to an inner surface of a case of the printer. However, a further anti-noise measure is demanded because the striking sound of the wire dot head 20 is very high.

Moreover, in the case of a flat platen 15, the surface of the platen 15 opposed to the tip of the wire dot head 20 is sometimes not parallel to the head tip. More particularly, for example if paper is conveyed from left to right in FIG. 8 and if a gap between the wire dot head 20 and the print head 15 on an upstream side in the paper conveying direction is a and that on a downstream side is b, the a and b are sometimes not equal to each other. In this case, there occurs a difference in print density between the upstream side and the downstream side, with consequent deterioration of the print quality. To eliminate such a difference there has been developed a mechanism for adjusting an inclination of the platen 15, but the structure of the mechanism and the adjusting work are complicated.

SUMMARY OF THE INVENTION

In certain embodiment, there is a platen having an impact absorbing element, it possible to damp a printing noise quickly in its generation source.

According to embodiment of the present invention, a platen having a surface opposed to a print head is fixed to a platen supporting member by a fixing member. In this case, a first impact absorbing member is interposed elastically between the platen and the platen supporting member. With a vibration absorbing action of the impact absorbing member, it is possible to prevent propagation of vibration between the platen and the platen supporting member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A first embodiment of the present invention is now explained with reference to FIGS. 1–3.

Figure 1:
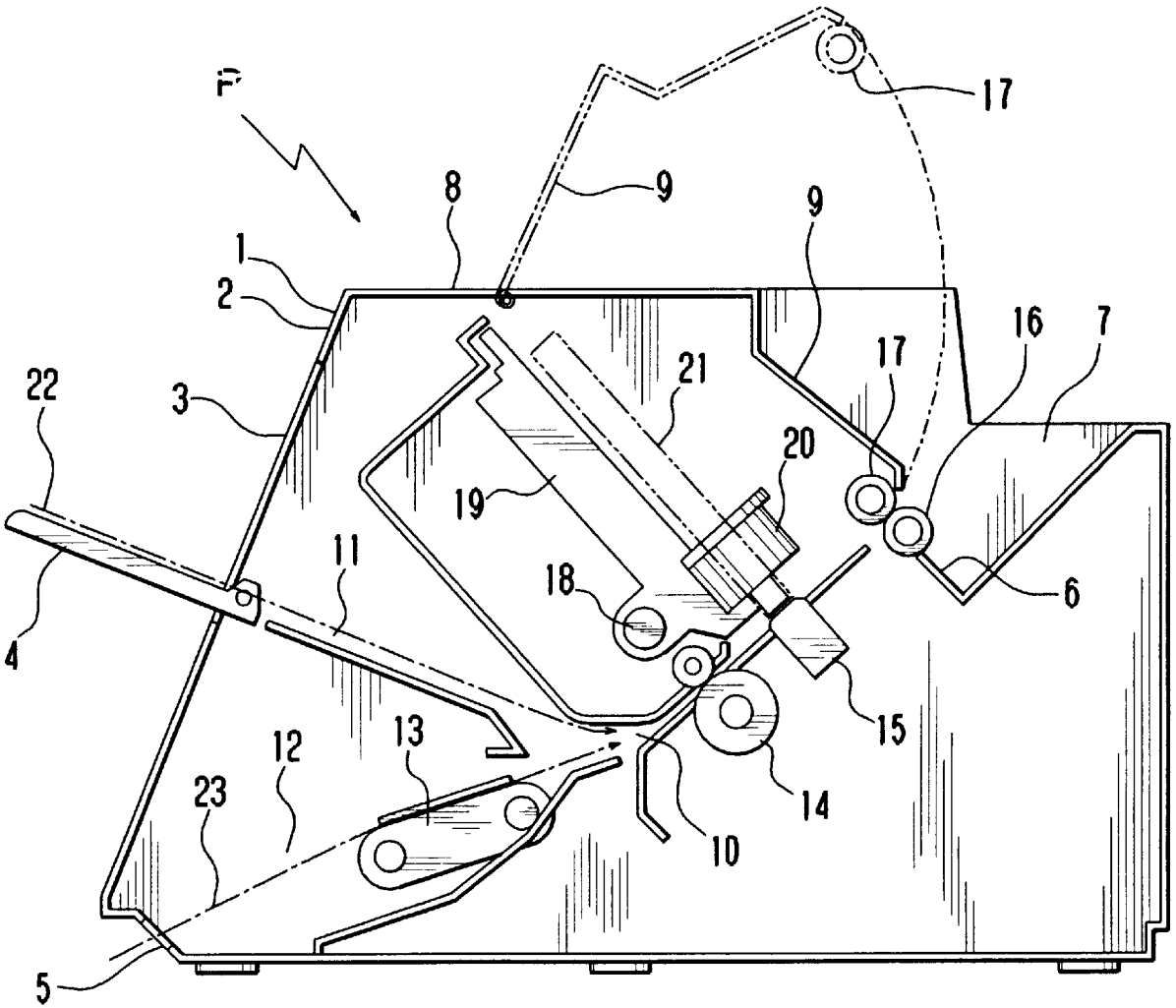
FIG. 1 is a side view in vertical section, showing an internal structure of a printer to which the present invention is applied.
Figure 2:
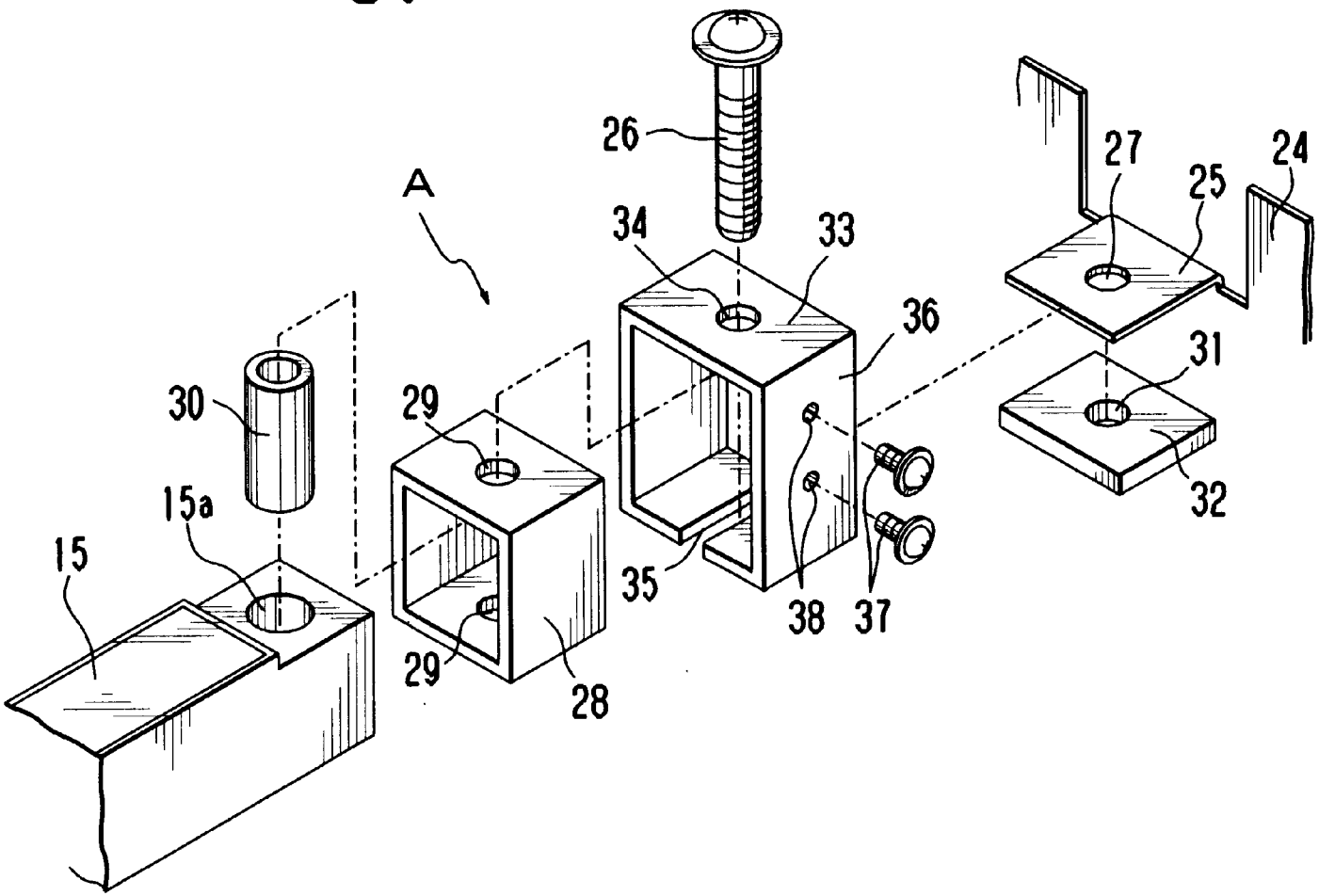
FIG. 2 is an exploded perspective view showing the construction of a platen supporting device according to a first embodiment of the present invention.
Figure 3:
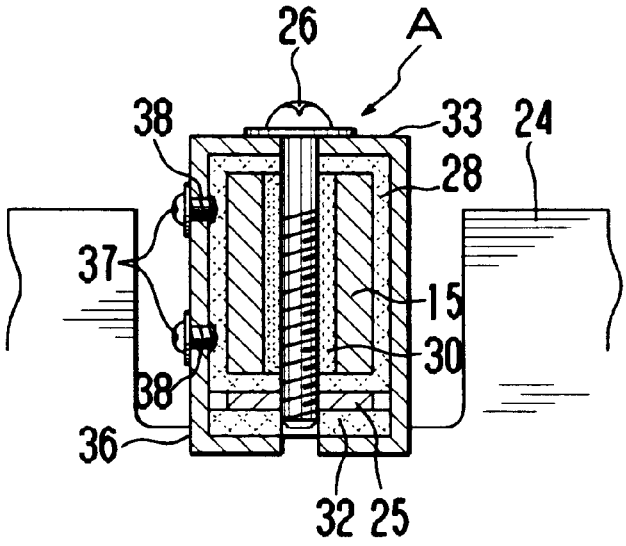
FIG. 3 is a side view in vertical section thereof.

FIG. 1 is a side view in vertical section, showing an internal structure of a printer, FIG. 2 is an exploded perspective view showing the construction of a platen supporting device, and FIG. 3 is a side view in vertical section thereof.

First, with reference to FIG. 1, a description will be given about the construction of a printer P. An opening 3 is formed in a front side 2 of a printer body 1, with a manual feed tray 4 being disposed in the opening 3 so as to be movable in opening and closing directions with respect to the opening 3. A paper feed port 5 is formed in a lower portion of the front side 2 of the printer body 1, while on a rear side 6 is provided a discharged paper receiving portion 7. Further, an opening/closing cover 9 is supported pivotably along an upper surface 8 of the printer body 1.

At a center of the printer body 1, a paper conveying passage 10 is formed. An upstream side of the paper conveying passage 10 is connected to both a paper feed passage 11 disposed on an extension plane of the manual feed tray 4 as opened and a paper feed passage 12 communicating with the paper feed port 5, while a downstream side of the paper conveying passage 10 is connected to the discharged paper receiving portion 7. A tractor 13 is disposed in the paper feed passage 12 and a pair of conveyance rollers 14 as paper conveying members and a platen 15 are disposed in the paper conveying passage 10. A delivery roller 16 is disposed in an inlet of the discharged paper receiving portion 7. A presser roller 17 is brought into pressure contact with the delivery roller 16 and it is supported pivotably on a free end side of the opening/closing cover 9. A carriage 19 is slidably fitted on a carriage shaft 18 which is parallel to axes of the conveyance rollers 14. A wire dot head 20 as a print head is mounted on the carriage 19 and an ink ribbon cassette 21 is supported removably by the carriage.

In case of using a slip 22 as printing paper in such a printer, the slip is fed from the manual feed tray 4, while in case of using continuous paper 23 as printing paper, the paper is fed from the paper feed port 5. No matter which printing paper may be used, the paper used is conveyed by the conveyance rollers 14 and is discharged to the discharged paper receiving portion 7 by the delivery roller 16. While the paper is thus conveyed, the carriage 19 is moved in the longitudinal direction of the platen 15 (in the direction perpendicular to the paper surface in FIG. 1) and printing is performed by the wire dot head 20.

Next, the construction of a platen supporting device A for supporting the platen 15 will now be described with reference to FIGS. 2 and 3. The platen 15 is a flat type having a square sectional shape, provided it may have another sectional shape insofar as its surface opposed to the wire dot head 20 is flat. Although only one side of the platen 15 is illustrated in FIG. 2, mounting holes 15*a* are formed respectively in both longitudinal ends of the platen 15. Frames 24 opposed to each other are provided at both longitudinal ends of the platen 15 and are respectively formed with platen supporting members 25 which are bent to support the platen 15. In each platen supporting member 25 is formed a tapped hole 27 for threaded engagement therewith of a mounting screw 26 as a fixing member.

A first impact absorbing member 28 of tube shape is fitted on each end portion of the platen 15. Through holes 29 for insertion therethrough of the mounting screw 26 are formed in both sides in the vertical direction of the first impact absorbing member 28. Further provided are a second impact absorbing member 30 which is cylindrical and which is inserted into a mounting hole 15*a* formed in the platen 15 and a third impact absorbing member 32 which is brought into contact with a lower surface of the associated platen supporting member 25 and which has a through hole 31 for insertion therein of the mounting screw 26. An inside diameter of the second impact absorbing member 30 is set at a value which permits the mounting screw 26 to be press-fitted therein, while an overall length of the second impact absorbing member 30 is set at a value which permits both ends thereof to come into contact with a ceiling surface and a bottom surface, respectively, of the first impact absorbing member 28. The first, second and third impact absorbing members 28, 30, 32 are formed using an elastically deflectable material having a high vibration absorbing characteristic such as rubber or a soft synthetic resin.

Further, a metallic, cylindrical cover 33 is provided which has a size capable of covering both the platen 15 and the first impact absorbing member 28 fitted in each end portion of the platen. A through hole 34 for insertion therethrough of the mounting screw 26 is formed on an upper surface of the cover 33, a slit 35 which permits the mounting screw 26 to project therethrough is formed in a bottom of the cover 33, and two tapped holes 38 for threaded insertion therein of clamp screws 37 are formed in a side face 36 of the cover 33, the clamp screws 37 being arranged in upper and lower positions respectively.

The following description is now provided about an assembling work for mounting the platen 15 to the platen supporting members 25. Since this assembling work is common to both end sides of the platen 15, reference will here be made to only one end side. With the second impact absorbing member 30 inserted into the mounting hole 15*a* of the platen 15, the first impact absorbing member 28 is fitted on the end portion of the platen 15, the cover 33 is fitted on the first impact absorbing member 28 from the outside, then the cover 33 is disposed so that the bottom thereof is positioned below the platen supporting member 25 and the third impact absorbing member 32 which is located below the platen supporting member, then in this state the mounting screw 26 is inserted successively through the through hole 34 of the cover 33, the upper through hole 29 of the first impact absorbing member 28, the second impact absorbing member 30, the lower through hole 29 of the first impact absorbing member 28, and the slit 35 of the cover 33, and the tip of the mounting screw 26 is brought into threaded engagement with the tapped hole 27 of the platen supporting member 25. In this way the platen 15 is mounted to the platen supporting member 25, as shown in FIG. 3.

In this construction, during printing, the platen 15 vibrates because it is struck by the wire dot head 20, but since the bottom of the first impact absorbing member 28 cylindrical in shape which surrounds the platen 15 comes into abutment against the platen supporting member 25, the propagation of vibration between the platen 15 and the platen supporting member 25 can be prevented by a vibration absorbing action of the first impact absorbing member 28. Besides, since the second impact absorbing member 30 cylindrical in shape is press-fitted on the mounting screw 26 inserted into the mounting hole 15*a* of the platen 15, the propagation of vibration between the platen 15 and the mounting screw 26 can be prevented by a vibration absorbing action of the second impact absorbing member 30.

Further, since the first impact absorbing member 28 is tube-shaped and comes into contact with the platen 15 over a wide area, the vibration absorbing action thereof is further enhanced. In this case, because of a cylindrical shape, the first impact absorbing member has a large surface area and is apt to be deformed under the influence of heat and a change with the lapse of time. However, since the outside of the first impact absorbing member is compressed by the cover 33, it is possible to diminish the influence of heat and a change with time and hence possible to maintain the vibration absorbing performance over a long period.

The cylindrical cover 33 also covers the platen supporting member 25, but since the third impact absorbing member 32 is interposed between the bottom of the cover 33 and the platen supporting member 25, even if the vibration of the platen 15 is propagated to the cover 33, the propagation of the vibration between the cover 33 and the platen supporting member 25 can be prevented by a vibration absorbing action of the third impact absorbing member 32.

As shown in FIG. 3, when the two upper and lower clamp screws 37 threadedly engaged with the tapped holes 38 formed in the side face 36 of the cover 33 are tightened, a pressure induced by the tightening of the screws is exerted on the platen 15 through the first impact absorbing member 28. Therefore, by adjusting the tightening force for the upper and lower clamp screws 37, it becomes possible to adjust the inclination of the platen 15 relatively with respect to the tip of the wire dot head 20.

In this case, since a periphery of the platen 15 is compressed by the cylindrical, first impact absorbing member 28 in the interior of the cover 33, the posture of the platen in its tilting direction can be rendered stable without the need of using any other fixing means.

In this inclination adjustment for the platen 15 the second impact absorbing member 30 also permits the tilting motion of the platen 15 by deflection, but if the second impact absorbing member 30 is omitted, the inclination angle of the platen 15 can be adjusted by an amount corresponding to the clearance between the mounting hole 15*a* of the platen 15 and the mounting screw 26.

A second embodiment of the present invention is now explained with reference to FIG. 4. The same parts as those in the first embodiment are designated by the same reference numerals and are not again explained herein.

Figure 4:
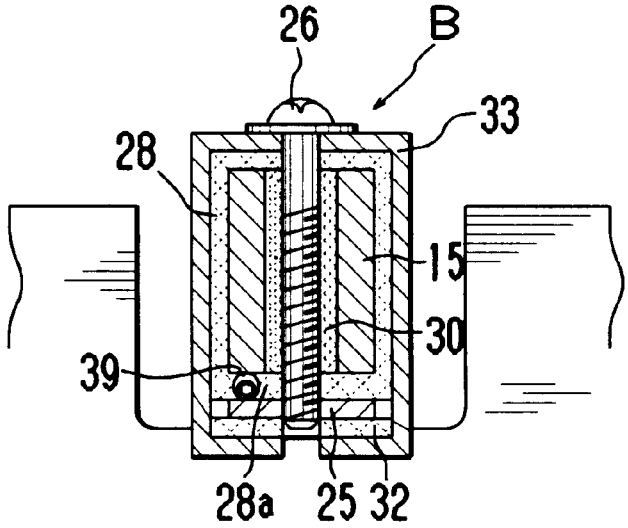
FIG. 4 is a side view in vertical section of a platen supporting device according to a second embodiment of the present invention.

FIG. 4 is a side view in vertical section of a platen supporting device according to a second embodiment of the present invention.

The platen supporting device of this embodiment, indicated at B, uses an eccentric cam 39 instead of the clamp screws 37. The eccentric cam 39 is provided on only one side with the mounting screw 26 as the center so as to press a lower end of the platen 15. Therefore, when the eccentric cam 39 is rotated, the platen 15 changes posture in its tilting direction while causing the first and second impact absorbing members 28, 30 to be deformed elastically. In this case, it is necessary that a cutout portion 28*a* for placing the eccentric cam 39 therein be formed in the first impact absorbing member 28.

As shown in FIG. 4, in the case where the eccentric cam 39 is to be journaled in a direction perpendicular to the paper surface in the same figure, this can be attained by providing a side wall orthogonal to the side face 36 of the cover 33 and allowing the side wall to support the eccentric cam 39. Of course, the eccentric cam 39 may be journaled rotatably by the side face 36 of the cover 33 as is the case with the clamp screws 37.

A third embodiment of the present invention is now explained with reference to FIGS. 5 and 6. The same parts as those in the first embodiment are designated by the same reference numerals and are not again explained herein.

Figure 5:
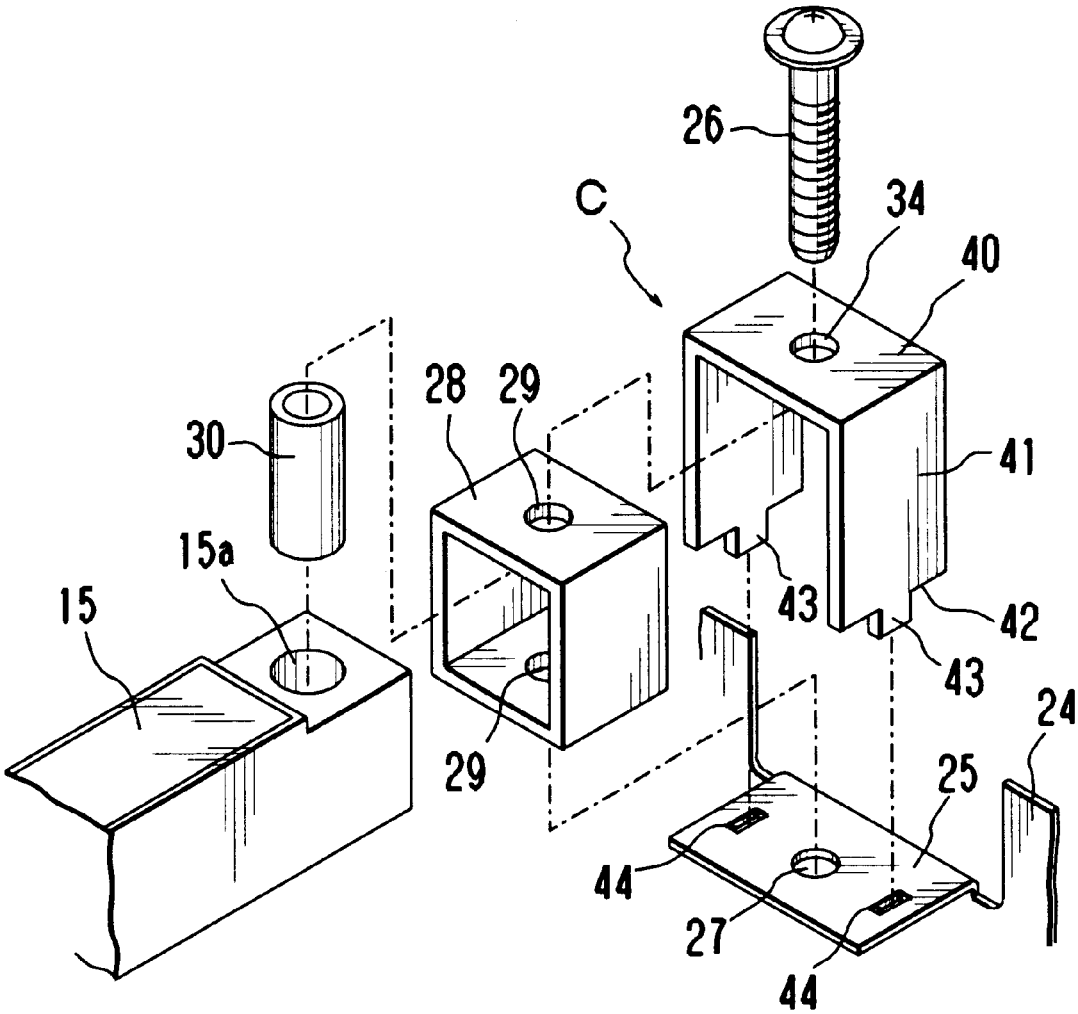
FIG. 5 is an exploded perspective view showing the construction of a platen supporting device according to a third embodiment of the present invention.
Figure 6:
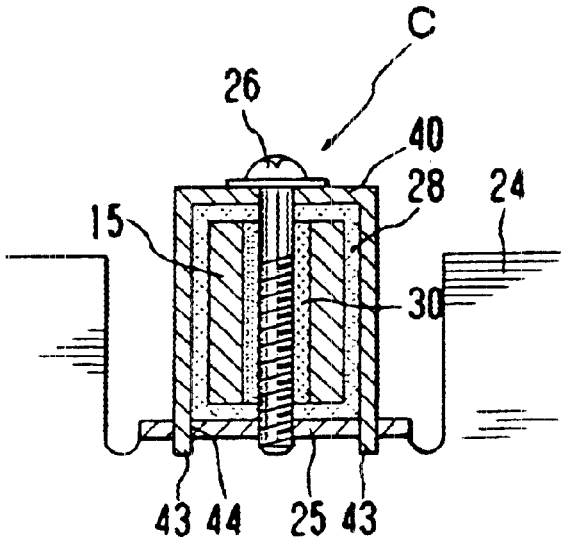
FIG. 6 is a side view in vertical section thereof.
Figure 7:
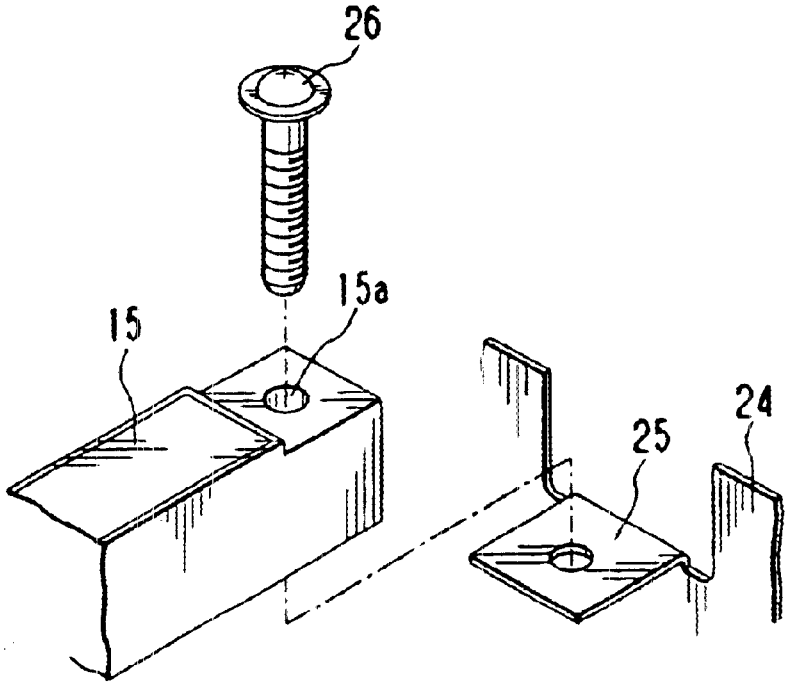
Fig. 7 PRIOR ART
FIG. 7 is an exploded perspective view showing a part of a conventional platen supporting structure.
Figure 8:
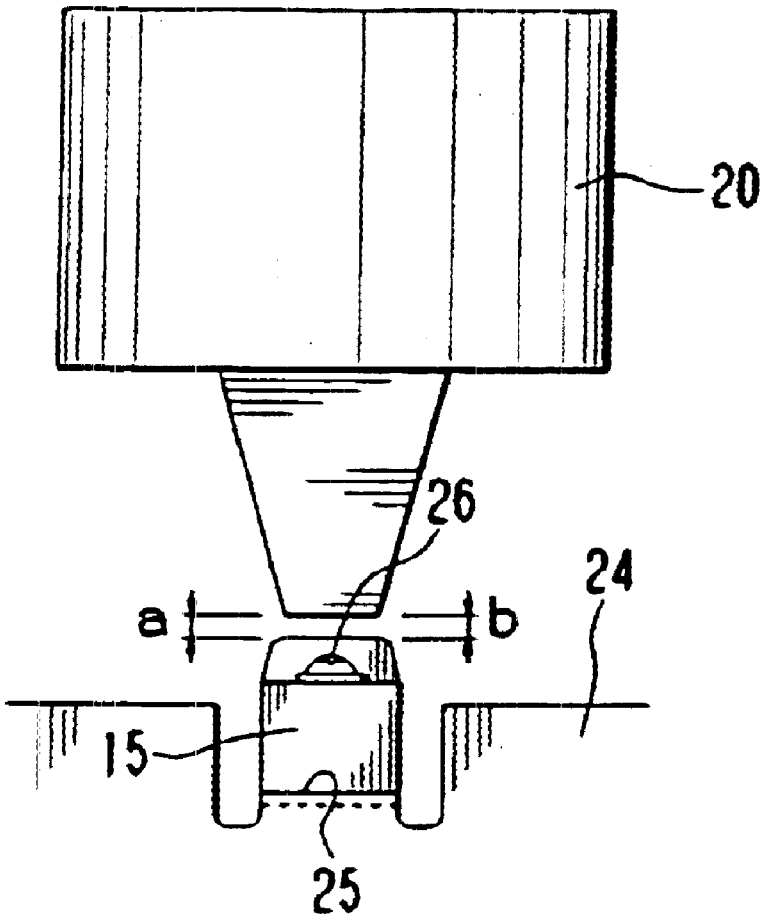
Fig. 8 PRIOR ART
FIG. 8 is a side view thereof.

FIG. 5 is an exploded perspective view showing the construction of a platen supporting device according to a third embodiment of the present invention and FIG. 6 is a side view in vertical section thereof.

In the platen supporting device of this embodiment, indicated at C, a cover 40 is formed in a turned square U-shape whose underside is open, with lugs 43 being formed centrally of lower edges 42 of both side faces 41. Fitting holes 44 for fitting therein of the lugs 43 are formed in the platen supporting member 25. The height of the cover 40 from a ceiling surface thereof which comes into contact with the upper surface of the first impact absorbing member 28 to each lower edge 42 is set at a value which permits pressing the first impact absorbing member 28 with a predetermined certain pressure.

Next, a description will be given about an assembling work for mounting the platen 15 to the platen supporting member 25. Since this mounting work is common to both end portions of the platen 15, reference will here be made to only one end portion. With the second impact absorbing member 30 inserted into the mounting hole 15*a* of the platen 15, the first impact absorbing member 28 is fitted on the end portion of the platen 15 and in this state is placed on the platen supporting member 25, then the cover 40 is applied onto the first impact absorbing member 28, allowing the lugs 43 to be fitted in the fitting holes 44. In this state, the mounting screw 26 is inserted successively through a through hole 34 formed in the cover 40, the upper through hole 29 of the first impact absorbing member 28, the second impact absorbing member 30, and the lower through hole 29 of the first impact absorbing member 28, and the tip of the mounting screw 26 is brought into threaded engagement with a tapped hole 27 formed in the platen supporting member 25. In this way the platen 15 is mounted to the platen supporting member 25, as shown in FIG. 6.

According to this construction, the lugs 43 of the cover 40 are fitted in the fitting holes 44 and the lower edges 42 thereof come into abutment against the upper surface of the platen supporting member 25, so that even if the mounting screw 26 is tightened with a strong force, the amount of compression of the first and second impact absorbing members 28, 30 are constant. Therefore, the height of the platen 15 can be kept constant.

Further, the lower edges 42 of the cover 40 come into abutment against the upper surface of the platen supporting member 25 and function to define the amount of compression of the first and second impact absorbing members 28, 30. Thus, the cover 40 exhibits a function as a pressing member which adjusts the inclination of the platen 15 by adjusting the position of the lower edges 42.

The platen supporting device of the third embodiment may also be provided with the third impact absorbing member.

Obviously, numerous modifications and variations of the present invention are possible in light of the above teachings. It is therefore to be understood that within the scope of the appended claims, the invention may be practiced otherwise than as specifically described herein.

What is claimed is:

1. A platen supporting device comprising:

a platen having a surface opposed to a print head;

a platen supporting member configured to support the platen;

a fixing member configured to fix the platen to the platen supporting member;

a first impact absorbing member disposed elastically between the platen and the platen supporting member; and a second impact absorbing member disposed elastically between the platen and the fixing member.

2. A platen supporting device comprising:

a platen having a surface opposed to a print head;

a platen supporting member configured to support the platen;

a fixing member configured to fix the platen to the platen supporting member;

a first impact absorbing member disposed elastically between the platen and the platen supporting member; and a cover configured to support the first impact absorbing member, together with the platen, in a compressed state.

3. A platen supporting device according to claim 2, wherein the cover is fixed to the platen supporting member by the fixing member so that the platen is fixed to the platen supporting member.

4. A platen supporting device according to claim 3, wherein a third impact absorbing member is disposed elastically between the platen supporting member and the cover.

5. A platen supporting device according to claim 3, wherein there is provided a pressing member which changes a pressure to be applied to a part of the platen in the interior of the cover thereby adjusting an inclination of the platen.

6. A platen supporting device comprising:

a platen having a surface opposed to a print head;

a platen supporting member configured to support the platen;

a fixing member configured to fix the platen to the platen supporting member; and a first impact absorbing member disposed elastically between the platen and the platen supporting device;

wherein the fixing member passes through the platen and is fixed to the platen supporting member; and wherein a direction in which the fixing member passes through the platen is parallel to a direction in which the platen is impacted.

7. A platen supporting device according to claim 6, wherein the fixing member is a screw adapted to engage the platen supporting member threadedly.

8. A platen supporting device according to claim 6, wherein the first impact absorbing member surrounds the platen and permits the fixing member to pass therethrough.

9. A platen supporting device according to claim 8, wherein there is provided a cover which supports the first impact absorbing member, together with the platen, in a compressed state, and the fixing member passes through not only the platen and the first impact absorbing member but also the cover and is fixed to the platens supporting member.

10. A platen supporting device according to claim 6, 7, 8, or 9, wherein a second impact absorbing member formed in a pipe shape is disposed between the platen and the fixing member.

11. A platen supporting device according to claim 9, wherein the cover lap around one side of the platen supporting member so as to sandwich the platen supporting member between the cover and the platen, and a third impact absorbing member is disposed elastically between the cover thus lapping around one side of the platen supporting member and the platen supporting member.

12. A platen supporting member according to claim 9, wherein there is provided a pressing member which changes a pressure to be applied to a part of the platen in the interior of the cover thereby adjusting an inclination of the platen.

13. A platen supporting device according to claim 12, wherein the pressing member comprises a plurality of clamp screws which is threadedly engaged with the cover and adapted to rotate to thereby change a pressure to be applied to the first impact absorbing member.

14. A platen supporting device according to claim 12, wherein the pressing member is constituted by an eccentric cam which is attached to the cover and adapted to rotate to thereby change a pressure to be applied to the first impact absorbing member.

15. A platen supporting device according to claim 7, wherein the first impact absorbing member surrounds the platen and permits the fixing member to pass therethrough.

16. A platen supporting device according to claim 15, wherein there is provided a cover which supports the first impact absorbing member, together with the platen, in a compressed state, and the fixing member passes through not only the platen and the first impact absorbing member but also the cover and is fixed to the platen supporting member.

17. A platen supporting device according to claim 16, wherein the cover has a side for abutment against the platen supporting member and determines an amount of compression of the first impact absorbing member by the abutment.

* * * * *